US007611550B2

(12) United States Patent
Fink

(10) Patent No.: US 7,611,550 B2
(45) Date of Patent: Nov. 3, 2009

(54) SLURRY FUELS AND ASSOCIATED METHODS

(75) Inventor: Lawrence E. Fink, Seattle, WA (US)

(73) Assignee: The Boeing Company, Chicago, IL (US)

( * ) Notice: Subject to any disclaimer, the term of this patent is extended or adjusted under 35 U.S.C. 154(b) by 594 days.

(21) Appl. No.: 11/227,930

(22) Filed: Sep. 15, 2005

(65) Prior Publication Data

US 2007/0056212 A1 Mar. 15, 2007

(51) Int. Cl.
*C10L 1/10* (2006.01)

(52) U.S. Cl. ..... 44/321; 44/456

(58) Field of Classification Search ..... 44/350, 44/351, 352, 353, 355, 459, 385, 393, 397, 44/403, 404, 572, 639, 300; 508/183; 423/579; 149/22; 502/202, 300, 304, 325, 302
See application file for complete search history.

(56) References Cited

U.S. PATENT DOCUMENTS

| | | | | |
|---|---|---|---|---|
| 2,622,277 | A | 12/1952 | Bonell et al. | |
| 2,771,739 | A | 11/1956 | Melina et al. | |
| 3,132,978 | A | 5/1964 | Scurlock et al. | |
| 3,197,348 | A | 7/1965 | Skolnik et al. | |
| 3,221,494 | A | 12/1965 | Chu | |
| 3,354,172 | A | 11/1967 | Takacs et al. | |
| 3,455,749 | A | 7/1969 | Gow et al. | |
| 3,857,743 | A | 12/1974 | Allan | |
| 3,931,374 | A | 1/1976 | Moutet nee Layrisse et al. | |
| 3,931,974 | A | 1/1976 | Goldfarb et al. | |
| 3,993,584 | A | 11/1976 | Owen et al. | |
| 4,090,895 | A * | 5/1978 | Outten | 149/22 |
| 4,141,768 | A | 2/1979 | Lo et al. | |
| 4,392,895 | A | 7/1983 | Reed, Jr. et al. | |
| 5,368,662 | A | 11/1994 | Willer et al. | |
| 5,641,731 | A * | 6/1997 | Baumgart et al. | 508/183 |
| 5,837,930 | A | 11/1998 | Mul et al. | |
| 6,835,218 | B1 * | 12/2004 | Drozd et al. | 44/459 |
| 2004/0265214 | A1 * | 12/2004 | Anderson | 423/579 |

OTHER PUBLICATIONS

Borax, Pioneer Magazine, From Missiles to Medicine: The developement of boron hydrides, Mar. 2001 (2 pgs).
Hermes B-1, Encyclopedia Astronautica, Aug. 28, 2004 (5 pgs).

(Continued)

*Primary Examiner*—Cephia D Toomer
*Assistant Examiner*—Latosha Hines
(74) *Attorney, Agent, or Firm*—Perkins Coie LLP

(57) ABSTRACT

Slurry fuels and associated methods are disclosed herein. One aspect of the invention is directed toward a slurry fuel that includes a liquid hydrocarbon based fuel suitable for use in an air-breathing power plant, metallic particles (e.g., boron), and a fluoropolymer (e.g., polytetrafluoroethylene). In selected embodiments the slurry fuel can further include a surfactant (e.g., polyolefin amide alkeneamine and/or Product NB463S84 produced by GE Betz, Inc.). Other aspects of the invention are directed toward a slurry fuel that includes a liquid hydrocarbon based fuel, metallic particles, and a surfactant having a composition that lowers the surface tension of the liquid hydrocarbon based fuel and reduces the tendency for the metallic particles to separate from the liquid hydrocarbon based fuel.

27 Claims, 1 Drawing Sheet

OTHER PUBLICATIONS

ITEM 4 Propellants, pp. 4-1 to 4-17 (date unknown).
Langley Colloquium Series, Advanced Fuels and Propellants—Exciting Ways of Improving Future Transportation and Exploration, Aug. 7, 2001, 2 pgs.
Lubrizol, Material Safety Data Sheet, HAZMAT Reporting System, MSDS 129100, Oct. 5, 2005, 6 pgs.
NB463S84, Material Safety Data Sheet, GE Betz, Inc., Mar. 2, 2004, 7 pgs.
Pinns, M.L. et al., Report 1388, NACA Research on Slurry Fuels, National Advisory Committee for Aeronautics, Aug. 15, 1958, pp. 1273-1296.
Salvesen, R.H., "Carbon Slurry Fuels for Volume Limited Missiles," Exxon Research and Engineering, Nov. 1979, 7 pgs.
Unreal Aircraft, Fuels for high performance aircraft, Apr. 4, 2005 (2 pgs).
Wiley, InterScience, Apr. 4, 2005, 3 pgs.

* cited by examiner

SLURRY FUELS AND ASSOCIATED METHODS

TECHNICAL FIELD

Embodiments of the present invention relate to slurry fuels and associated methods, including: slurry fuels comprised of a hydrocarbon based fuel, boron, and polytetrafluoroethylene; and slurry fuels comprised of a hydrocarbon based fuel, boron, and a surfactant.

BACKGROUND

Due to operational constraints, many aerospace vehicles have limited volume for fuel carriage. Accordingly, it can be important to increase the fuel energy per gallon of fuel carried in order to extend the operational range of the vehicle. For example, cruise missiles often have size constraints based on radar cross-sectional signature, visual acquisition, and launch platform considerations. These size constraints often limit the amount of fuel that can be carried by the cruise missile. Therefore, for a given amount of fuel, if the energy per gallon of fuel carried can be increased, the operational range of the cruise missile can be increased accordingly.

Various fuel additives have been tried over the years to improve various fuel performance parameters in air-breathing turbine engines. Additionally, various fuel additives have also been tried for fuels used in propellants. Propellants generally include both a fuel and an oxidizing agent (e.g., a chemical or substance other than atmospheric oxygen that brings about an oxidizing reaction or combustion). Accordingly, many propellants can be used to fuel power plants that operate outside of the atmosphere. In many cases, by improving fuel performance overall propellant performance can also be increased. Accordingly, research involving various fuel additives continues.

SUMMARY

The present invention is directed generally toward slurry fuels and associated methods. Aspects of the invention are directed toward a slurry fuel that includes a liquid hydrocarbon based fuel suitable for use in an air-breathing power plant. The slurry fuel can further include metallic particles. The particles can be mixed with the hydrocarbon based fuel. The slurry fuel can still further include a fluoropolymer (e.g., polytetrafluoroethylene) mixed with the liquid hydrocarbon based fuel. In selected embodiments, the slurry fuel can further include a surfactant.

Other aspects of the invention are directed toward a slurry fuel that includes a liquid hydrocarbon based fuel and metallic particles. The particles can be mixed with the liquid hydrocarbon based fuel. The slurry fuel can further include a surfactant having a composition that lowers the surface tension of the liquid hydrocarbon based fuel and reduces the tendency for the particles to separate from the liquid hydrocarbon based fuel. In certain embodiments, the surfactant can include at least one of polyolefin amide alkeneamine and/or Product NB463S84 produced by GE Betz, Inc. In other embodiments, the slurry fuel can include a fluoropolymer mixed with the liquid hydrocarbon based fuel.

Still other aspects of the invention are directed toward a method for producing power with an air-breathing power plant that includes introducing a slurry fuel into the air-breathing power plant. The slurry fuel can include a liquid hydrocarbon based fuel, metallic particles, and a fluoropolymer. In certain embodiments, the slurry fuel can also include a surfactant.

DETAILED DESCRIPTION

The present disclosure describes slurry fuels and associated methods. Several specific details of the invention are set forth in the following description and in FIGS. 1-2 to provide a thorough understanding of certain embodiments of the invention. One skilled in the art, however, will understand that the present invention may have additional embodiments, and that other embodiments of the invention may be practiced without several of the specific features described below.

Figure 1:
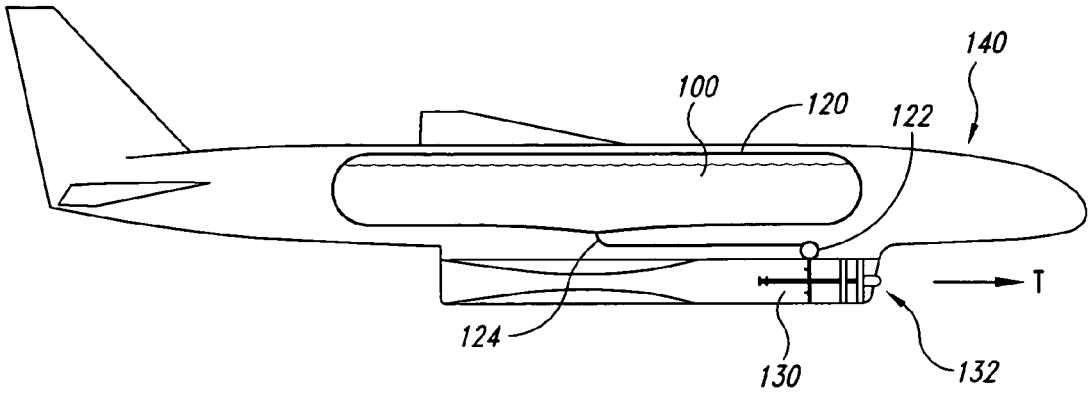
FIG. 1 is a partially schematic cross-sectional view of a vehicle carrying a slurry fuel in accordance with embodiments of the invention.

FIG. 1 is a partially schematic cross-sectional view of a vehicle 140 carrying a slurry fuel 100 in accordance with embodiments of the invention. In FIG. 1, the vehicle 140 includes an aerospace vehicle (e.g., a cruise missile) that carries a power plant 130. In the illustrated embodiment, the power plant 130 includes an air-breathing power plant or engine that receives air through an inlet 132. In FIG. 1, the air-breathing power plant is configured to produce power in the form of thrust T by burning a slurry fuel 100 without the use of an oxidizing agent (e.g., only using oxygen available from the atmospheric air that flows through the inlet 132). In other embodiments, the air-breathing power plant shown in FIG. 1 can include other types of air-breathing power plants (e.g., a ramjet engine). In the illustrated embodiment, the slurry fuel can be stored in a tank 120 carried by the vehicle 140 and delivered to the power plant 130 via one or more lines 124 and/or one or more pumps 122. In certain embodiments, the combustion or oxidation of the slurry fuel 100 can provide performance benefits over existing fuels. In other embodiments, the slurry fuel 100 can include a surfactant that reduces the tendency of solid and liquid portions of the slurry fuel 100 to separate.

In certain embodiments of the invention, the slurry fuel 100 can be comprised of a liquid hydrocarbon based fuel mixed with metallic particles. In various embodiments, the hydrocarbon based fuels can include various alcohol based fuels and kerosene based fuels (e.g., including JP-4, JP-5, JP-7, JP-8, JP-10, and Jet A). The particles can include one or more of various metals including boron, aluminum, manganese, magnesium, titanium, beryllium, and the like. In certain embodiments, the particles can have a cross-sectional dimension of 10 microns or less (e.g., nanoparticles ranging in size from 0.001-10 microns). In some cases, the small size of the particles can improve combustion or oxidation efficiency of the metallic particle by providing a high surface area per weight. In certain embodiments, the particles can comprise 0.1 to 66 percent of the slurry fuel 100 by weight. In other embodiments, the particles can comprise an even higher percentage of the slurry fuel 100 (e.g., 80 percent or more), however, in certain cases the ability for the pump 122 to delivery the slurry fuel 100 to the power plant 130 can be degraded with these higher concentrations of particles, particularly in low temperature conditions.

A feature of some of the embodiments discussed above is that the addition of metallic particles to a hydrocarbon based fuel can improve fuel performance during various operating conditions over the use of the hydrocarbon based fuel alone. For example, in some cases the mass flow through a turbojet engine can be increased, providing additional thrust. Additionally, in some embodiments selected metallic elements (e.g., boron) contained in the metallic particles are combustible and can provide additional energy during combustion or oxidation. In some cases, this additional energy can be used to produce additional thrust for a vehicle or improve fuel economy.

In other embodiments, the slurry fuel 100 can also include a fluoropolymer in addition to the liquid hydrocarbon based fuel and metallic particles. In certain cases, the fluoropolymer can have a composition such that a halogen and/or halogenated small molecule is released upon thermal degradation of the fluoropolymer. In turn, the halogen and/or halogenated small molecule can have a composition that can improve the combustion or oxidation of the metallic particles during thermal degradation of the slurry fuel 100. For example, in selected embodiments the fluoropolymer can include polytetrafluoroethylene (e.g., a polytetrafluoroethylene powder). One form of polytetrafluoroethylene is known as Teflon® and is available from the DuPont Corporation of Wilmington, Del. In some embodiments for which the particles include boron particles and the fluoropolymer includes polytetrafluoroethylene, the polytetrafluoroethylene can reduce the tendency for boron oxide to form on the surface of the particles during combustion or oxidation. When boron oxide forms on the surface of the particles, it can prevent further combustion or oxidation of the material below the surface of the particles, thereby reducing the overall combustion or oxidation efficiency. By reducing the formation of boron oxide, the combustion efficiency of the boron particles can be increased, providing more energy from the boron particles during thermal degradation. In certain embodiments, the ratio of fluoropolymer to the metallic particles can range between 0.0001 and 0.20 by weight. In selected embodiments for which the fluoropolymer includes a polytetrafluoroethylene powder, the polytetrafluoroethylene particles in the powder can have a cross-sectional dimension of 100 microns or less (e.g., 0.001-100 microns). In other embodiments, the polytetrafluoroethylene particles in the powder can have a cross-sectional dimension of 50 microns or less.

A feature of some of the embodiments discussed above is that the fluoropolymer can aid the combustion or oxidation rate of the metallic particles allowing more energy to be extracted during thermal degradation of a slurry fuel during the limited time the fuel is passing though the power plant. An advantage of this feature is that more energy can be produced for a given amount of slurry fuel. For example, in some cases this feature can allow the range of a vehicle (e.g., a cruise missile) to be increased without having to increase the volume of fuel carried by the vehicle.

In still other embodiments of the invention, the slurry fuel 100 can also contain a surfactant having a composition that lowers the surface tension of the liquid hydrocarbon based fuel and reduces the tendency for solids (e.g., the metallic particles and/or other solids including a fluoropolymer powder) to separate from the liquid hydrocarbon based fuel. For example, in certain cases a surfactant can have molecules that are compatible with one or more of the elements of the slurry fuel and can allow a slurry mixture to be stored for an extended period of time without the solid particles in the slurry separating from the liquid portion of the slurry (e.g., settling to the bottom and/or floating to the top). Additionally, in certain embodiments a surfactant can reduce the tendency for solid and liquid components of a slurry fuel 100 to separate when carried by the vehicle 140 during periods of acceleration (e.g., high g conditions). In selected embodiments where the slurry fuel includes JP-10 and boron particles (with or without a fluoropolymer), polyolefin amide alkeneamine and/or Product NB463S84 produced by GE Betz, Inc. of Trevose, Pa. have been found to act as suitable surfactants. One type of polyolefin amide alkeneamine is available as Product OS#172983B, 1X.125 LT from The Lubrizol Corporation of Wickliffe, Ohio. In various embodiments, the ratio of surfactant to metallic particles (e.g., boron particles) can ranges between 0.0001 and 0.1 by weight. As discussed above, a surfactant can be used in a slurry fuel having a liquid hydrocarbon based fuel and metallic particles, with or without a fluoropolymer.

In some cases, once a solid portion of a slurry fuel separates from a liquid portion, the fuel can be difficult to pump and/or lose the beneficial properties provided by the fuel slurry. A feature of some of the embodiments discussed above is that a surfactant can reduce the tendency for solid and liquid portions of a slurry fuel to separate. An advantage of this feature is that the slurry fuel with a surfactant can be stored for longer periods and/or be subjected to higher acceleration forces (e.g., g loads) without separating.

Figure 2:
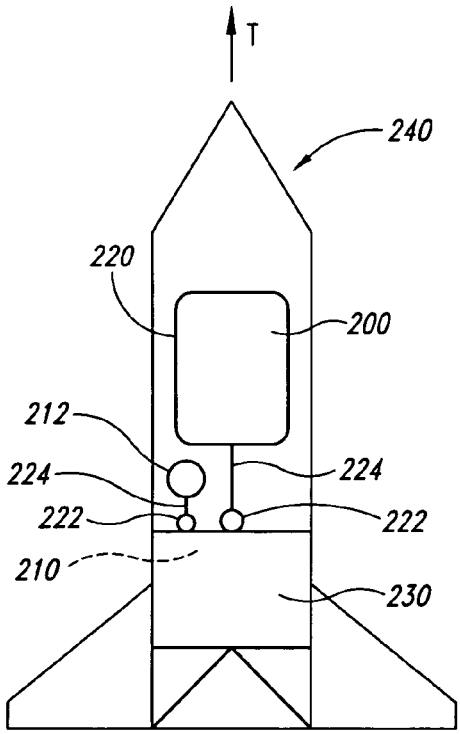
FIG. 2 is a partially schematic cross-sectional view of a vehicle carrying a slurry fuel in accordance with other embodiments of the invention.

Although the embodiments discussed above with reference to FIG. 1 have been discussed in the context of an air-breathing power plant or engine and without the use of an oxidizing agent, they can also be applicable to non-air-breathing power plants and/or with the use of an oxidizing agent. FIG. 2 is a partially schematic cross-sectional view of a vehicle 240 (e.g., a rocket) carrying a slurry fuel 200 in accordance with other embodiments of the invention. In the illustrated embodiment, the vehicle 240 carries the slurry fuel 200 in a tank 220 and also carries an oxidizing agent 212 separate from the slurry fuel 200. The oxidizing agent 212 and slurry fuel 220 can be delivered to a vehicle power plant 230 via lines 224 and pumps 222. In FIG. 2, the power plant 230 is a non-air-breathing power plant that uses the propellant 210 formed by the slurry fuel 200 and the oxidizing agent 212 to produce power in the form of thrust T.

In certain embodiments for which the slurry fuel 200 and oxidizing agent 212 require a catalyst for ignition, the oxidizing agent 212 can be stored or mixed with the slurry fuel 200 (e.g., stored together in the same tank) and a catalyst can be used to initiate the combustion or oxidation process. In still other embodiments, the slurry fuel can be mixed with an oxidizing agent and still used in an air-breathing power plant. For example, a flow of an oxidizing agent can be mixed with a flow of slurry fuel in an air-breathing turbine power plant to chemically ignite the slurry fuel. After ignition, the flow of the oxidizing agent can be terminated and the combustion of the slurry fuel can be self-sustaining. Although various embodiments above have been discussed with reference to power plants carried by aerospace vehicles, in other embodiments the power plants and slurry fuels can be carried by other types of vehicles (e.g., a ship) and/or can be stationary (e.g., a turbine powered generator in a building).

The following are non-limiting specific examples of a slurry fuel in accordance with embodiments of the invention.

Example 1

A slurry fuel comprising JP-10 fuel mixed with boron particles, polytetrafluoroethylene powder, and polyolefin amide alkeneamine. The boron particles can generally have a cross-sectional dimension of approximately 0.8 microns. The boron particles and polytetrafluoroethylene powder (e.g., the solid components of the present embodiment) can comprise approximately 22 percent of the slurry fuel by weight. The ratio of the polytetrafluoroethylene powder to boron particles can be approximately 0.12 by weight and the ratio of polyolefin amide alkeneamine to boron particles can be approximately 0.04 by weight. In certain embodiments for which the slurry fuel is used in an air-breathing power plant, the air entering the combustion section can be at approximately 534 K, the fuel entering the combustion section can be at approximately 298 K, and the combustion temperature can be approximately 2515 K. In other embodiments, the slurry fuel can be used in a power plant having different operating conditions and/or temperatures. As discussed above, in other embodiments the various components of the slurry fuel can have other concentrations relative to one another. For example, in selected embodiments the solids can be increased so that they comprise 50-65 percent of the slurry fuel by weight, or higher.

Example 2

A slurry fuel comprising JP-10 fuel mixed with boron particles and polyolefin amide alkeneamine. The boron particles can generally have a cross-sectional dimension of approximately 0.8 microns. The boron particles can comprise approximately 22 percent of the slurry fuel by weight and the ratio of polyolefin amide alkeneamine to boron particles can be approximately 0.04 by weight. As discussed above, in other embodiments the various components of the slurry fuel can have other concentrations relative to one another. For example, in selected embodiments the concentration of boron particles can be increased so that they comprise 50-65 percent of the slurry fuel by weight, or higher. Additionally, in other embodiments the polyolefin amide alkeneamine can be replaced with Product NB463S84 produced by GE Betz, Inc.

Example 3

A slurry fuel comprising a hydrocarbon based fuel mixed with aluminum particles and polyolefin amide alkeneamine. The aluminum particles can generally have a cross-sectional dimension of 10 microns or less. The aluminum particles can comprise up to 65 percent of the slurry fuel by weight and the ratio of polyolefin amide alkeneamine to aluminum particles can be approximately 0.04 by weight. As discussed above, in other embodiments the various components of the slurry fuel can have other concentrations relative to one another. For example, in selected embodiments the polyolefin amide alkeneamine can be replaced with Product NB463S84 produced by GE Betz, Inc. In other embodiments, the slurry fuel can also include polytetrafluoroethylene. For example, the ratio of polytetrafluoroethylene to the aluminum particles can ranges between 0.0001 and 0.20 by weight.

From the foregoing, it will be appreciated that specific embodiments of the invention have been described herein for purposes of illustration, but that various modifications may be made without deviating from the invention. Additionally, aspects of the invention described in the context of particular embodiments or examples may be combined or eliminated in other embodiments. For example, in certain embodiments discussed above the fluoropolymer can include a perfluoropolymer. Although advantages associated with certain embodiments of the invention have been described in the context of those embodiments, other embodiments may also exhibit such advantages. Additionally, not all embodiments need necessarily exhibit such advantages to fall within the scope of the invention. Accordingly, the invention is not limited except as by the appended claims.

I claim:

1. A slurry fuel, comprising:

a liquid hydrocarbon based fuel suitable for use in an air-breathing power plant;

metallic particles, the particles being mixed with and suspended in the liquid hydrocarbon based fuel, the metallic particles containing at least one of boron, aluminum, manganese, magnesium, titanium, and beryllium; and a fluoropolymer mixed with the liquid hydrocarbon based fuel, the fluoropolymer having a composition containing a plurality of fluorinated monomers, wherein the fluoropolymer is configured to release fluorine and/or the fluorinated monomers upon thermal degradation.

2. The slurry fuel of claim 1 wherein:

the liquid hydrocarbon based fuel includes JP-10;

the particles include boron particles generally having a cross-sectional dimension of 10 microns or less and wherein the boron particles comprise between 0.1 and 66 percent of the slurry fuel by weight;

the fluoropolymer includes a polytetrafluoroethylene powder mixed into the slurry fuel so that the include ratio of polytetrafluoroethylene to the boron particles ranges between 0.0001 and 0.20 by weight, and wherein the slurry fuel further comprises a surfactant, wherein the surfactant includes polyolefin amide alkeneamine, and wherein the ratio of surfactant to boron particles ranges between 0.0001 and 0.1 by weight.

3. The slurry fuel of claim 1 wherein the liquid hydrocarbon based fuel includes at least one of an alcohol base fuel and a kerosene based fuel.

4. The slurry fuel of claim 1 wherein the liquid hydrocarbon based fuel includes at least one of JP-4, JP-5, JP-7 JP-8, JP-10, and Jet A fuel.

5. The slurry fuel of claim 1 wherein the particles include at least one of boron, aluminum, manganese, magnesium, titanium, and beryllium.

6. The slurry fuel of claim 1 wherein the particles include boron particles generally having a cross-sectional measurement of 10 microns or less.

7. The slurry fuel of claim 1 wherein the fluoropolymer includes at least one of polytetrafluoroethylene and a perfluoropolymer.

8. The slurry fuel of claim 1 wherein the fluoropolymer includes a powder comprised of polytetrafluoroethylene and wherein the polytetrafluoroethylene particles in the powder have a cross-sectional measurement of 100 microns or less.

9. The slurry fuel of claim 1 wherein the fluoropolymer has a composition such that at least one of a halogen and a halogenated small molecule is released upon thermal degradation, the at least one of a halogen and a halogenated small molecule having a composition that improves the combustibility of the particles during thermal degradation of the slurry fuel.

10. The slurry fuel of claim 1, further comprising a surfactant having a composition that lowers the surface tension of the liquid hydrocarbon based fuel and reduces the tendency for the particles to separate from the liquid hydrocarbon based fuel.

11. The slurry fuel of claim 1, further comprising polyolefin amide alkeneamine.

12. The slurry fuel of claim 1 wherein the slurry fuel is suitable for use in an air-breathing power plant without the use of an oxidizing agent.

13. The slurry fuel of claim 1 wherein the particles comprise between 0.1 and 80 percent of the slurry fuel by weight.

14. The slurry fuel of claim 1 wherein the fluoropolymer is mixed with the liquid hydrocarbon based fuel so that the ratio of fluoropolymer to the metallic particles ranges between 0.0001 and 0.20 by weight.

15. A slurry fuel, comprising:

a liquid hydrocarbon based fuel;

metallic particles, the particles being mixed with and suspended in the liquid hydrocarbon based fuel;

a surfactant having a composition that lowers the surface tension of the liquid hydrocarbon based fuel and reduces the tendency for the metallic particles to separate from the liquid hydrocarbon based; and a fluoropolymer mixed with the liquid hydrocarbon based fuel, the fluoropolymer having a composition containing a plurality of fluorinated monomers, wherein the fluoropolymer is configured to release fluorine and/or the fluorinated monomers upon thermal degradation.

16. The slurry fuel of claim 15 wherein:

the liquid hydrocarbon based fuel includes at least one of an alcohol based fuel and a kerosene based fuel;

the particles include boron particles;

the surfactant includes polyolefin amide alkeneamine, and wherein the ratio of surfactant to boron particles ranges between 0.0001 and 0.1 by weight.

17. The slurry fuel of claim 15 wherein the surfactant includes polyolefin amide alkeneamine.

18. The slurry fuel of claim 15 wherein the fluoropolymer includes a powder comprised of polytetrafluoroethylene.

19. The slurry fuel of claim 15 wherein the slurry fuel is suitable for combining with an oxidizing agent.

20. A method for producing power with an air-breathing power plant, comprising:

introducing a slurry fuel into the air-breathing power plant, the slurry fuel including:

a liquid hydrocarbon based fuel;

a plurality of metallic particles, the particles being mixed with the liquid hydrocarbon based fuel, wherein the solid particles individually containing a metal;

a fluoropolymer mixed with the liquid hydrocarbon based fuel, the fluoropolymer having a composition containing a plurality of fluorinated monomers;

releasing fluorine and/or the fluorinated monomers upon thermal degradation from the fluoropolymer; and reducing formation of a metal oxide on a surface of individual solid particles with the released fluorine and/or the fluorinated monomers.

21. The method of claim 20 wherein introducing a slurry fuel includes introducing a slurry fuel comprised of the liquid hydrocarbon based fuel, the particles, and the fluoropolymer, wherein:

the liquid hydrocarbon based fuel includes an alcohol based fuel and a kerosene based fuel;

the particles include boron particles;

the fluoropolymer includes polytetrafluoroethylene.

22. The method of claim 20 wherein the air-breathing power plant is carried by an aerospace vehicle.

23. The method of claim 20 wherein the air-breathing power plant is carried by an aerospace vehicle and wherein the aerospace vehicle does not carry an oxidizing agent.

24. The method of claim 20 wherein the slurry fuel further includes a surfactant having a composition that lowers the surface tension of the liquid hydrocarbon based fuel and reduces the tendency for the metallic particles to separate from the liquid hydrocarbon based fuel.

25. The method of claim 20 wherein the slurry fuel further includes polyolefin amide alkeneamine.

26. A fuel suitable for use in an air-breathing power plant, comprising:

a liquid hydrocarbon;

a polytetrafluoroethylene mixed in the liquid hydrocarbon; and a plurality of solid particles suspended in the liquid hydrocarbon containing the polytetrafluoroethylene, the solid particles containing a metal selected from the group consisting of boron, aluminum, manganese, magnesium, titanium, and beryllium; and wherein the plurality of solid particles, the polytetrafluoroethylene, and the liquid hydrocarbon form a slurry.

27. The slurry fuel of claim 26 wherein:

the liquid hydrocarbon based fuel includes JP-10;

the solid particles include solid boron particles generally having a cross-sectional dimension of 10 microns or less, and wherein the boron particles comprise between 0.1 and 66 percent of the slurry by weight; and a ratio of the polytetrafluoroethylene to the boron particles ranges between about 0.0001 and about 0.20 by weight, and wherein the slurry further comprises a surfactant containing polyolefin amide alkeneamine, and wherein the ratio of the surfactant to the boron particles ranges between about 0.0001 and about 0.1 by weight.

* * * * *

UNITED STATES PATENT AND TRADEMARK OFFICE

CERTIFICATE OF CORRECTION

PATENT NO. : 7,611,550 B2
APPLICATION NO. : 11/227930
DATED : November 3, 2009
INVENTOR(S) : Lawrence E. Fink It is certified that error appears in the above-identified patent and that said Letters Patent is hereby corrected as shown below:

On Title page, in column 1, under "U.S. Patent Documents", line 2, delete "Melina et al." and insert -- Malina et al. --, therefor.

On Title page, in column 2, under "Other Publications", line 1-2, delete "developement" and insert -- development --, therefor.

In column 6, line 31, in claim 3, delete "base" and insert -- based --, therefor.

In column 6, line 34, in claim 4, after "JP-7" insert -- , --.

In column 7, line 12, in claim 15, delete "based;" and insert -- based fuel; --, therefor.

Signed and Sealed this

Twentieth Day of July, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,611,550 B2
APPLICATION NO. : 11/227930
DATED : November 3, 2009
INVENTOR(S) : Lawrence E. Fink It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1003 days.

Signed and Sealed this

Twelfth Day of October, 2010

David J. Kappos

David J. Kappos
*Director of the United States Patent and Trademark Office*